US005414210A

United States Patent [19]

Sato

[11] Patent Number: 5,414,210

[45] Date of Patent: May 9, 1995

[54] MULTIPLE OSCILLATOR ELECTRONIC MUSICAL INSTRUMENT HAVING A REDUCED NUMBER OF SUB-OSCILLATORS AND DIRECT-READ/WRITE OF MODULATION CONTROL SIGNALS

[75] Inventor: Yasushi Sato, Shizuoka, Japan

[73] Assignee: Kabushiki Kaisha Kawai Gakki Seisakusho, Japan

[21] Appl. No.: 145,803

[22] Filed: Oct. 29, 1993

[30] Foreign Application Priority Data

Nov. 2, 1992 [JP] Japan ..... 4-315568
Nov. 2, 1992 [JP] Japan ..... 4-315569

[51] Int. Cl.[6] ..... G10H 1/057; G10H 1/46

[52] U.S. Cl. ..... 84/627; 84/629; 84/633; 84/702; 84/711

[58] Field of Search ..... 84/622–633, 84/675–677, 692–711

[56] References Cited

U.S. PATENT DOCUMENTS 3,999,456 12/1976 Tsunoo et al. ..... 84/695 X
4,205,579 6/1980 Kakehashi ..... 84/708
4,409,877 10/1983 Budelman ..... 84/675

*Primary Examiner*—Stanley J. Witkowski
*Attorney, Agent, or Firm*—Andrus, Sceales, Starke & Sawall

[57] ABSTRACT

An electronic musical instrument according to the present invention has oscillators for generating a tone waveform; a modulator for modulating a musical tone; a modulation controller for determining a degree of modulation to be performed by the modulator; and a central control unit for controlling the oscillators, the modulator and the modulation controller. A memory stores a current control value of the modulation controller, and an input/output device reads a control value stored in the memory, by the central controller, and/or writes a control value stored in the memory into the central controller to ensure the control of the degree of modulation and the alteration of frequency bands.

4 Claims, 22 Drawing Sheets

MULTIPLE OSCILLATOR ELECTRONIC MUSICAL INSTRUMENT HAVING A REDUCED NUMBER OF SUB-OSCILLATORS AND DIRECT-READ/WRITE OF MODULATION CONTROL SIGNALS

BACKGROUND OF THE INVENTION

1. Field of the Invention

The present invention relates to an electronic musical instrument, and particularly to an electronic musical instrument that produces a desired tone signal by employing multiple oscillators.

2. Description of the Related Art

Nowadays, various electronic musical instruments, such as electronic keyboards, electronic pianos, and synthesizers, have been developed and are in practical use. Such electronic musical instruments employ multiple oscillators, for example, 16 or 32 oscillators, to produce basic portions of musical tones.

Musical tones produced by the oscillators, however, are monotonous, and the emotional, rich sounds obtained when playing natural musical instruments cannot be expected. Most electronic musical instruments, therefore, have sub-oscillators that produce sound effects, such as vibrato, tremolo, and growl, and an envelope generator that adjusts volume and alters frequency bands.

In such an electronic musical instrument, musical tones that are produced by main oscillators are modulated by employing low-frequency musical tones that are produced by sub-oscillators to obtain a variety of sound effects, such as vibrato. As tone wave data are written to the oscillators, modulation wave data are written to the sub-oscillators, so that a desired musical tone is generated in response to the input from a keyboard.

This system however requires 16 sub-oscillators if it has 16 oscillators, and its circuit structure is thus complicated and expensive to fabricate. Although one method has been tested that reduces the sub-oscillator count in consonance with the maximum simultaneously produced timbre count, a satisfactory structure has not yet been designed.

These sub-oscillators, as described above, add modulation to produce sound effects, such as vibrato. Although the types of modulation frequencies employed do not have to have the same counts as oscillators, multiple similarly structured sub-oscillators are provided. Regarding the circuit structure and its cost, the wasteful practice of providing the same number of sub-oscillators as the number of oscillators or as the number of simultaneously produced timbres has been employed.

Most of the envelope generators employed for such electronic musical instruments provide target values and the speeds required to reach these values. To effect volume changes or to alter frequency bands, usually target values are changed.

On the other hand, as the variety of available electronic musical instruments has increased, so too has the demand for electronic musical instruments with improved ease of manipulation. Especially required are real time techniques for modulation control, such as those that can be employed for volume control and frequency band control.

Since a conventional system, however, cannot control such modulations in real time, it has to employ many additional circuits, such as a multiplier, a switching circuit, a table conversion circuit, and an interpolation circuit. As its circuit size is thus enlarged, its cost is consequently increased.

SUMMARY OF THE INVENTION

It is therefore a first object of the present invention to provide an electronic musical instrument that has a simplified circuit structure of a conventional tone generating section, and that requires a minimal number of sub-oscillators, regardless of the oscillator and the simultaneously produced timbre counts.

It is a second object of the present invention to provide an electronic musical instrument that can directly read and write modulation control signals, which are produced by modulation control means such as an envelope generator, for the tone generating section of a conventional electronic musical instrument, and that can perform real-time control with fewer additional circuits.

To achieve the first object, an electronic musical instrument according to the present invention, which employs multiple oscillators to produce musical tones, comprises: sub-oscillators provided in a count smaller than that of the oscillators; storage means for temporarily storing the output of the sub-oscillators; sub-oscillator selection memory means provided for each of the multiple oscillators; and modulation means for, by arranging the sub-oscillators in consonance with their frequencies, employing, as modulation data for the oscillators, the output of one of the sub-oscillators selected in consonance with a value stored in the sub-oscillator selection memory means, and for employing, as a modulation frequency, the selected sub-oscillator value.

With the above described arrangement of the present invention, the count of the included oscillators is the same as the count of available timbres, and the minimum number of sub-oscillators is provided. The output of the sub-oscillators, which is temporarily retained in the storage means, is selectively extracted, by the sub-oscillator selection memory means provided for each of the multiple oscillators, and employed to modulate oscillator output.

In this fashion, the number of sub-oscillators can be considerably reduced, and the circuit structure can be drastically simplified. This is especially effective for an electronic musical instrument that has many produced timbres and incorporates many oscillators.

To achieve the second object, an electronic musical instrument according to the present invention comprises: oscillators for generating a tone waveform; modulation means for modulating a musical tone; modulation control means for determining a degree of modulation to be performed by the modulation means; central control means for, upon receipt of a tone generation command, controlling the oscillators, the modulation means and the modulation control means so as to produce or modulate a musical tone; storage means for storing a current control value of the modulation control means; and input/output means for reading a control value stored in the storage means, by the central control means, and/or for writing a control value stored in the storage means into the central control means to ensure the control of the degree of modulation.

The present invention performs direct reading and writing of a modulation control signal that is generated by modulation control means. Therefore, although an electronic musical instrument has only a few additional circuits, such as a gate circuit, it can control, in real time, the modulation of volume and the alteration of frequency bands.

DETAILED DESCRIPTION OF THE PREFERRED EMBODIMENT

Figure 1:
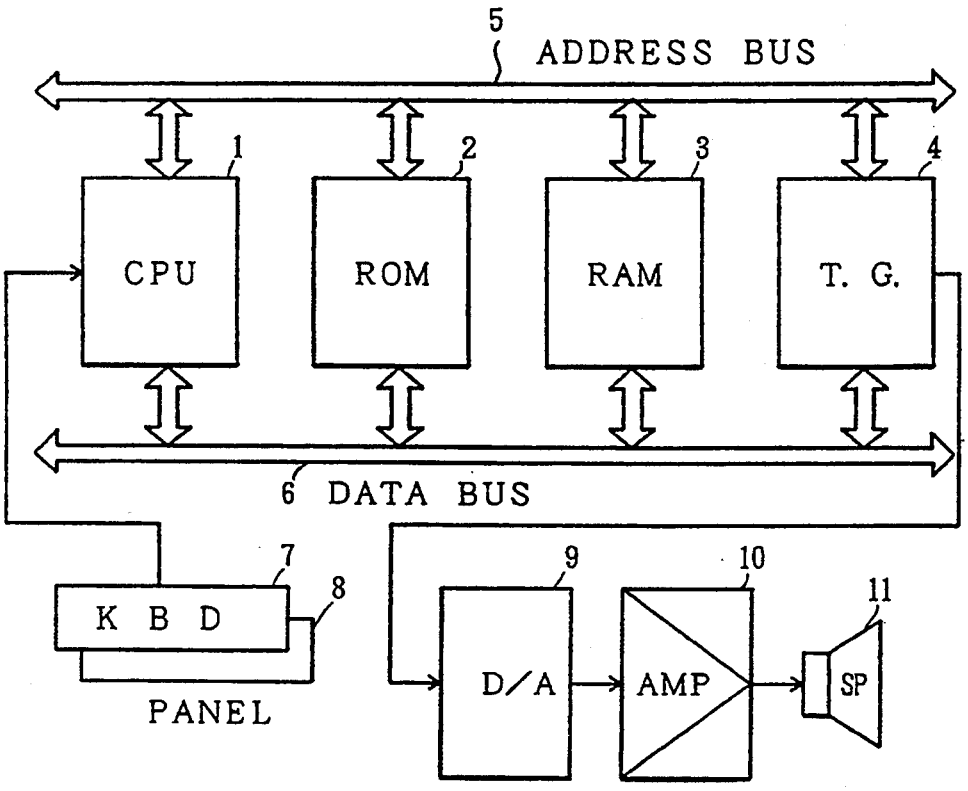
FIG. 1 is a block diagram illustrating the general arrangement of an electronic musical instrument according to the present invention.

FIG. 1 is a block diagram illustrating the general arrangement of an electronic musical instrument according to the present invention. In FIG. 1, a central processing unit (hereinafter referred to as a "CPU") 1 sequentially reads a control program that is stored in a program memory section of a read only memory (hereinafter referred to as a "ROM") 2 via an address bus 5 and a data bus 6, and controls the individual sections of the electronic musical instrument by executing the program.

Stored in the ROM 2, besides the control program for activating the CPU 1, are tone wave data and various other fixed data.

Predetermined data that are initially stored in the ROM 2 are transmitted to and retained by a random access memory (hereinafter referred to as a "RAM") 3. Also in the RAM 3 are various registers, for controlling the electronic musical instrument, and a work area.

Under the control of the CPU 1, a tone generator (hereinafter referred to as a "T.G.") 4, which includes multiple oscillators, for example, 32 or 16, employs time-sharing to produce musical tones. The T.G. 4 will be described in detail later.

The address bus 5 is alternately used by the CPU 1 and the T.G. 4 as a time-shared route for the exchange of required address data. The data bus 6 is employed by the CPU 1 and the T.G. 4 to exchange necessary data.

A keyboard 7 is an assembly of keys and key switches that transmit signals to the CPU 1 when a player depresses or releases keys. A panel 8 is an assembly comprising a control panel and sensors/switches that are employed to transmit information relative to timbre changes, volume adjustments, and frequency-band alterations, which are initiated by a player, to the CPU 1.

A D/A converter 9 is a digital/analog converter that converts digital tone data, which are generated by the T.G. 4, into analog data. The converted analog tone data are amplified to a desired level by an amplifier (Amp) 10, and are emitted as acoustic output by a loudspeaker 11, an electric/acoustic converter.

Figure 2:
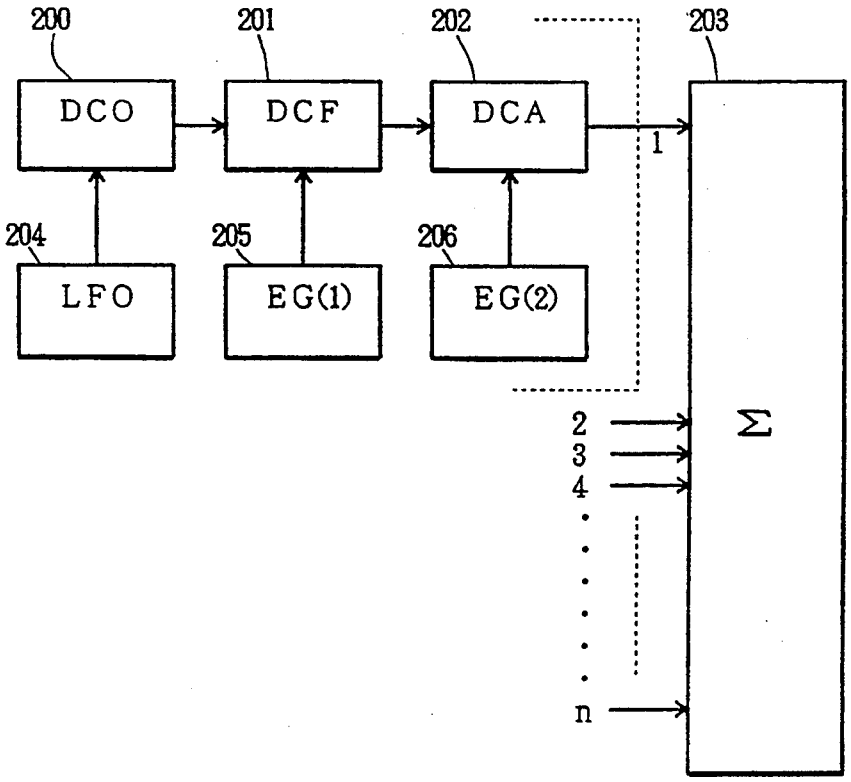
FIG. 2 is a block diagram illustrating the arrangement of a tone generator of the electronic musical instrument according to the present invention.

FIG. 2 shows the example arrangement of the T.G. 4 in FIG. 1. In actuality, the T.G. 4 comprises a multiplicity of circuits to produce, for example, 32 musical tones, but for this example only a single circuit structure is depicted. A DCO 200, a digital control oscillator, reads a tone wave stored in the ROM 4 (see FIG. 1) and produces necessary musical tones. Time-sharing is employed to enable common use of necessary portions of the circuits 200 through 206 by multiple circuits.

A DCF 201, a digital control filter, adds frequency-band modulation to a tone wave that is output by the DCO 200. A DCA 202, a digital control amplifier, adds amplitude modulation to a tone wave that is output by the DCF 201.

A digital mixer (Σ) 203 adds the tone wave signals from the DCA's 202 of, for example, 32 oscillator circuits and outputs the resultant stereophonic signal. An LFO 204 is a sub-oscillator that generates a low frequency to provide frequency modulation for the DCO 200.

An EG(1) 205 is an envelope generator (1) that controls a frequency band of the DCF 201. An EG(2) 206 is an envelope generator (2) that controls an amplitude (an amplification factor) that is changed by the time axis of the DCA 202.

Figure 3:
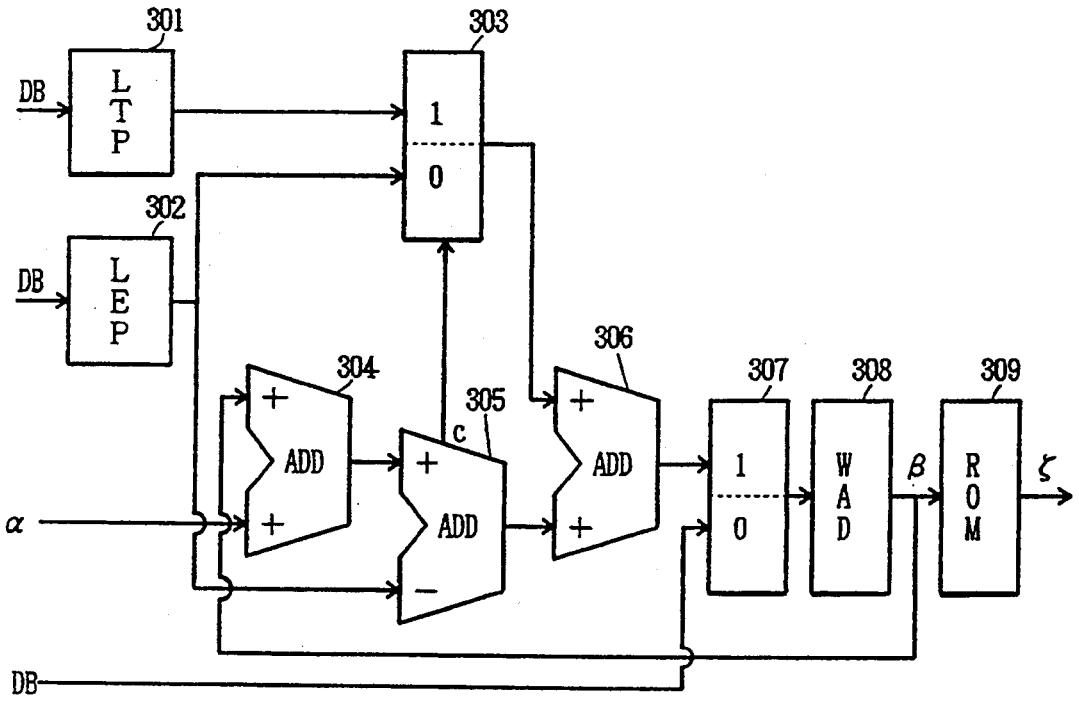
FIG. 3 is a block diagram showing the arrangement of a digital control oscillator of the electronic musical instrument according to the present invention.

FIG. 3 shows the detailed arrangement example for the digital control oscillator, DCO 200, depicted in FIG. 2. An LTP (Loop Top Point) 301 is a RAM where a loop top address for a read waveform is stored, and an LEP (Loop End Point) 302 is a RAM where a loop end address of a read waveform is stored. Data writing to the LTP 301 and the LEP 302 is performed by the CPU 1, shown in FIG. 1, via the data bus 6 (hereafter referred to as a "DB") 6. An address in this case is a pointer to an oscillator number.

A selector 303 is selection means for selecting one of the outputs of the LTP 301 and LEP 302. This selection is performed in consonance with a carry signal from an adder 305, which will be described later, and either "1" or "0" is selected.

An adder 304 adds input $\alpha$ (obtained by a circuit in FIG. 5, as will be described later) to output $\beta$ of this circuit. The adder 305 subtracts the output of the LEP 302 from the output of the adder 304. In consonance with its state, the adder 305 transmits a carry signal to the selector 303, and this carry signal is utilized to effect a selected status change.

An adder 306 adds the output of the selector 303 to the output of the adder 305. A selector 307 is selection means for selecting a signal that has been transmitted via the DB 6 when a write signal generated by the CPU 1 in FIG. 1 is true, and for selecting the output of the adder 306 when a write signal is not true. A WAD 308 is a RAM that stores an address for reading a waveform and that outputs a signal $\beta$. In this case, the address is a pointer to an oscillator number.

When the CPU 1 is in a wait state, output $\beta$ is sent to a ROM 309 (ROM 2 in FIG. 1) that outputs DCO output $\zeta$.

Figure 4:
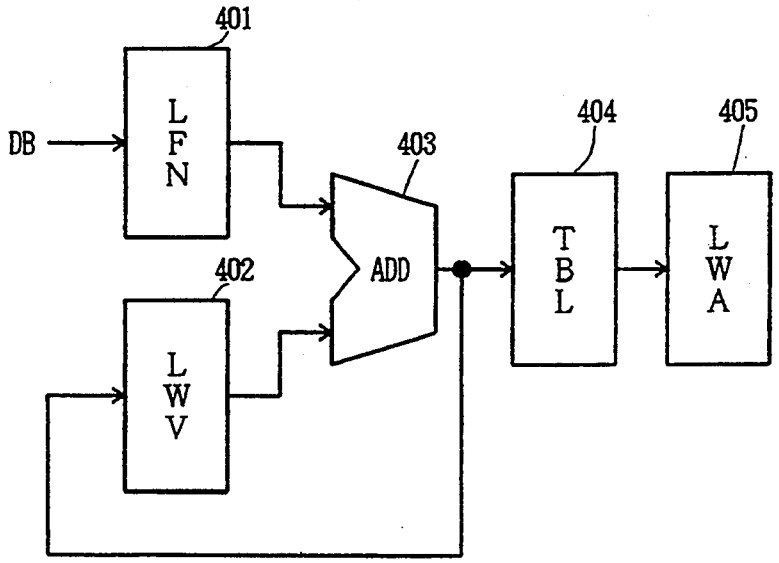
FIG. 4 is a block diagram showing the arrangement of a sub-oscillator, i.e., a low frequency oscillator, of the electronic musical instrument according to the present invention.

FIG. 4 illustrates the detailed arrangement example for the LFO 204, a sub-oscillator, shown in FIG. 2. Fewer LFO's 204 are provided than digital control oscillators (DCO) 200; for example, while in this instance 32 DCO's 200 are provided, only 16 LFO's 204, half the DCO count, are provided. An LFN 401 is a RAM in which is stored data that specifies a low frequency for the LFO 204. The LFN 401 receives an address signal from the CPU 1 (FIG. 1) via the DB 6. In this instance, the address is a pointer to a sub-oscillator (LFO) number.

An LWV 402 is a RAM in which a table read address is stored. This address is also a pointer to a sub-oscillator (LFO) number. An adder 403 adds the output of the LFN 401 to the output of the LWV 402. As a result, a series of nearly sawtooth waveform outputs are generated until a given level is reached.

A table TBL 404 is a function table that receives as an address the nearly sawtooth waveform that is output by the LFO 204, converts the waveform into one that is suitable for modulation, such as a sine wave, and outputs the resultant waveform. An LWA 405 is a RAM in which the output of the adder 403 is temporarily stored. The write address in this instance is a pointer to a sub-oscillator number.

Figure 5:
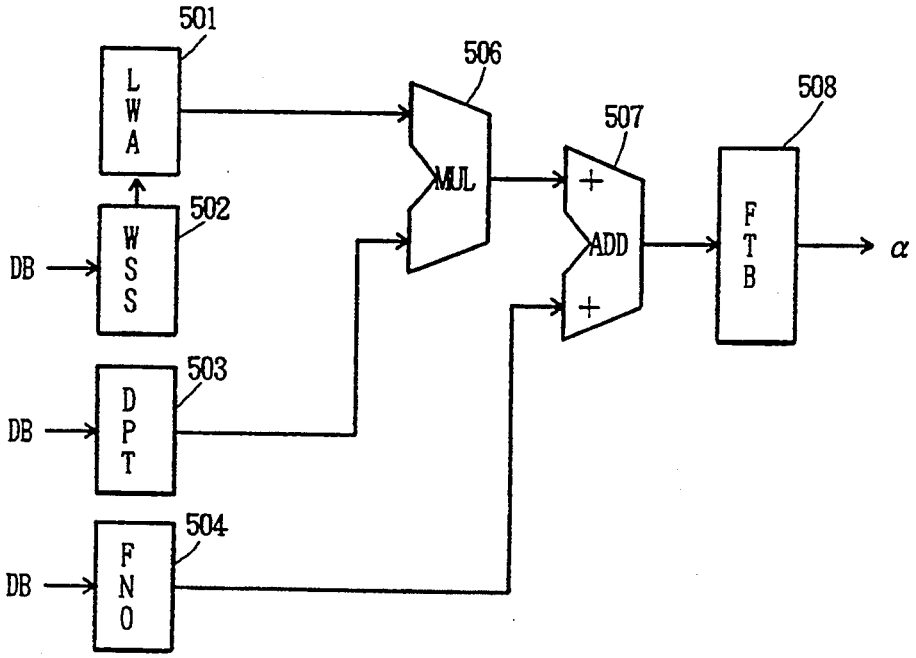
FIG. 5 is a block diagram showing the circuit arrangement that determines and modulates the frequency of the digital control oscillator of the electronic musical instrument according to the present invention.

FIG. 5 illustrates an example arrangement for a circuit that determines the output frequency of the digital control oscillator (DCO) 200 in FIG. 2 and that modulates that frequency in consonance with the output of the LFO 204. An LWA 501 in FIG. 5 is the same as the LWA 405 shown in FIG. 4; for this example there are 16 LWA's 501 provided. A WSS 502 is a RAM in which is stored an LWA selection number that is utilized to select the output of the LWA 501 for every oscillator. An address that is received from the CPU 1 (FIG. 1) via the DB 6 is a pointer to an oscillator number. The output of the WSS 502 is transmitted as a read address for the LWA 501.

An FNO 504 is a RAM in which are stored data that indicate a referential frequency (non-modulated frequency) for the digital control oscillator (DCO) 200 in FIG. 2. Data is sent from the CPU 1 (FIG. 1) via the DB 6. An address in this case is a pointer to an oscillator number. A DPT 503 is a RAM in which is stored modulation depth data by which the depth of modulation for each oscillator is controlled. Data is sent from the CPU 1 (FIG. 1) via the DB 6. An address in this case is a pointer to an oscillator number.

A multiplier 506 multiplies the output. of the LWA 501 and the output of the DPT 503. An adder 507 adds the output of the multiplier 506 to the output of the FNO 504, and sends the result as an address to a frequency table (FTB) 508, which is a ROM table. In the FTB table this logarithmic input is converted into linear output $\alpha$. Finally, output $\alpha$ is transmitted to the digital control oscillator (DCO) 200 in FIG. 2.

Figure 6:
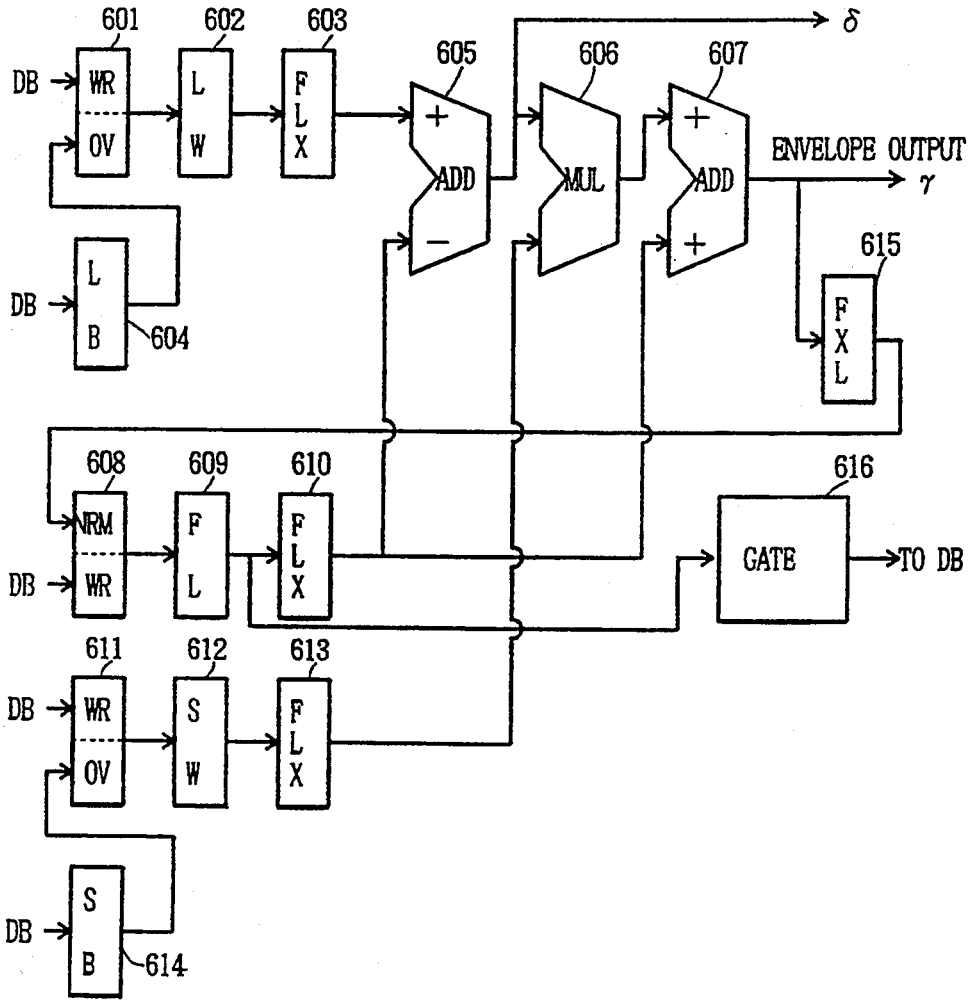
FIG. 6 is a block diagram showing the arrangement of an amplitude changing envelope generator of the electronic musical instrument according to the present invention.

FIG. 6 is a detailed diagram showing the example arrangement for the envelope generator (EG(2)) 206 in FIG. 2. Arithmetic operation of this circuit is performed by employing an asymptotic expression $E_{n+1}=S^*(L-E_n)$. A selector 601, which has a gate, selects the WR input when it receives an interrupt signal from the CPU 1 (FIG. 1), and selects the OV input when it receives a signal $\epsilon$ (an overflow signal). In other cases, the selector 601 has no output. An LW 602 is a RAM in which a current target value L of an envelope is stored. An address in this case is a pointer to an oscillator number.

An FLX 603 is a converter that converts floating point data into fixed point data. An LB 604 is a RAM in which, in consonance with input via the DB 6, is stored the target value of the next phase of an envelope. An address in this case is a pointer to an oscillator number.

An adder 605 subtracts the output of the FLX 610 from the output of the converter 603. A multiplier 606 multiplies the output of the adder 605 and the output of an FLX 610, which will be described later. An adder 607 adds the output of the multiplier 606 to the output of the FLX 610. The result is employed as envelope output $\gamma$.

A selector 608 selects the WR side when it receives a write signal WR from the CPU 1 (FIG. 1), and selects the NRM side for the other cases. Output $\gamma$ is transmitted to one terminal of the selector 608 via an FXL 615 that converts fixed point data into floating point data.

An FL 609 is a RAM in which a current value En of an envelope is stored. An address in this case is a pointer to an oscillator number. The FLX 610 is the same kind of converter as the FLX 603. A selector 611 has a gate and functions the same as the selector 601.

An SW 612 is a RAM in which current speed S of an envelope is stored. An address in this case is a pointer to an oscillator number. An FLX 613 is the same kind of converter as the FLX 603. An SB 614 is a RAM in which the speed for the next phase of an envelope is stored. An address in this instance is a pointer to an oscillator number. A gate 616 is a three-state gate circuit that sends the output of the FL 609 to the DB 6 in consonance with the data read by the CPU 1 (FIG. 1).

Figure 7:
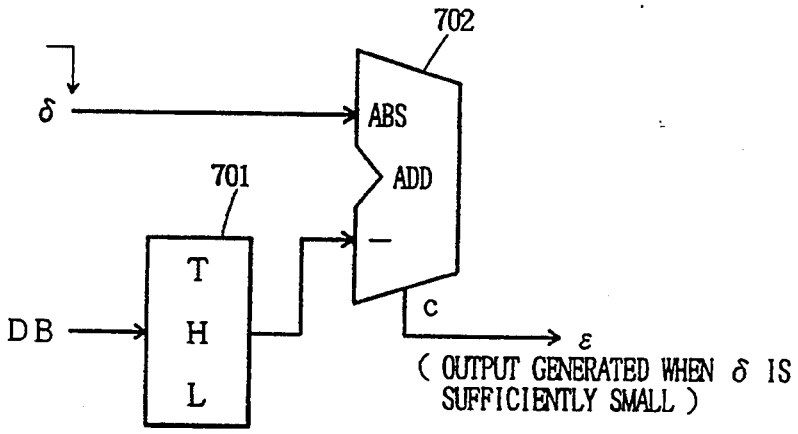
FIG. 7 is a block diagram showing the arrangement of a circuit that compares overflow signal $\epsilon$ by employing data $\delta$ in FIG. 6.

FIG. 7 is a comparison circuit that generates an overflow signal $\epsilon$ in consonance with data $\delta$ shown in FIG. 6. A THL 701, a latch circuit that stores a boundary value, receives data via the DB 6 from the CPU 1 (FIG. 1). An adder 702 subtracts the output of the THL 701 from the absolute value of input $\delta$ and generates a carry signal. When input $\delta$ is very small, therefore, carry signal $\epsilon$ is generated.

Figure 8:
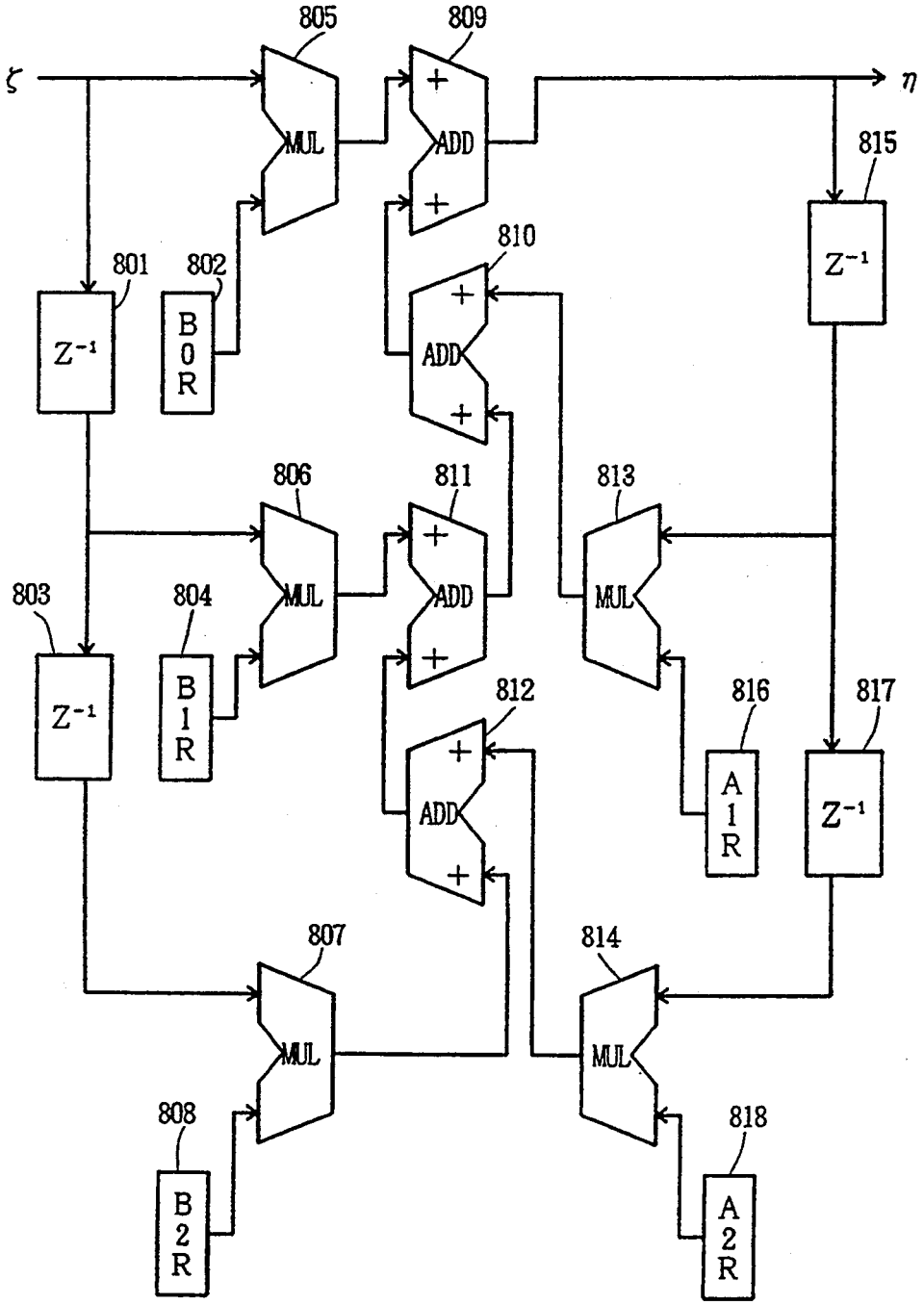
FIG. 8 is a block diagram illustrating the arrangement of a digital control filter of the electronic musical instrument according to the present invention.

FIG. 8 shows the detailed example arrangement for the digital control filter (DCF) 201 in FIG. 1. Reference numbers 801, 803, 815, and 817 denote delay circuits that delay the input by one cycle of system sampling. Reference numbers 802, 804, 808, 816, and 818 denote ROMs in which are stored coefficients to determine a cut off frequency for the filter. An address in this case is a pointer to the output of the envelope generator (EG(1)) 205 that changes a cut off frequency in FIG. 2.

Multipliers 805, 806, 807, 813, and 814 multiply their received data. Adders 809, 810, 811, and 812 add their received data. Upon receipt of output $\zeta$ from the digital control oscillator (DCO) 200 (FIG. 2), predetermined addition or multiplication is performed on this output to obtain output $\eta$.

Figure 9:
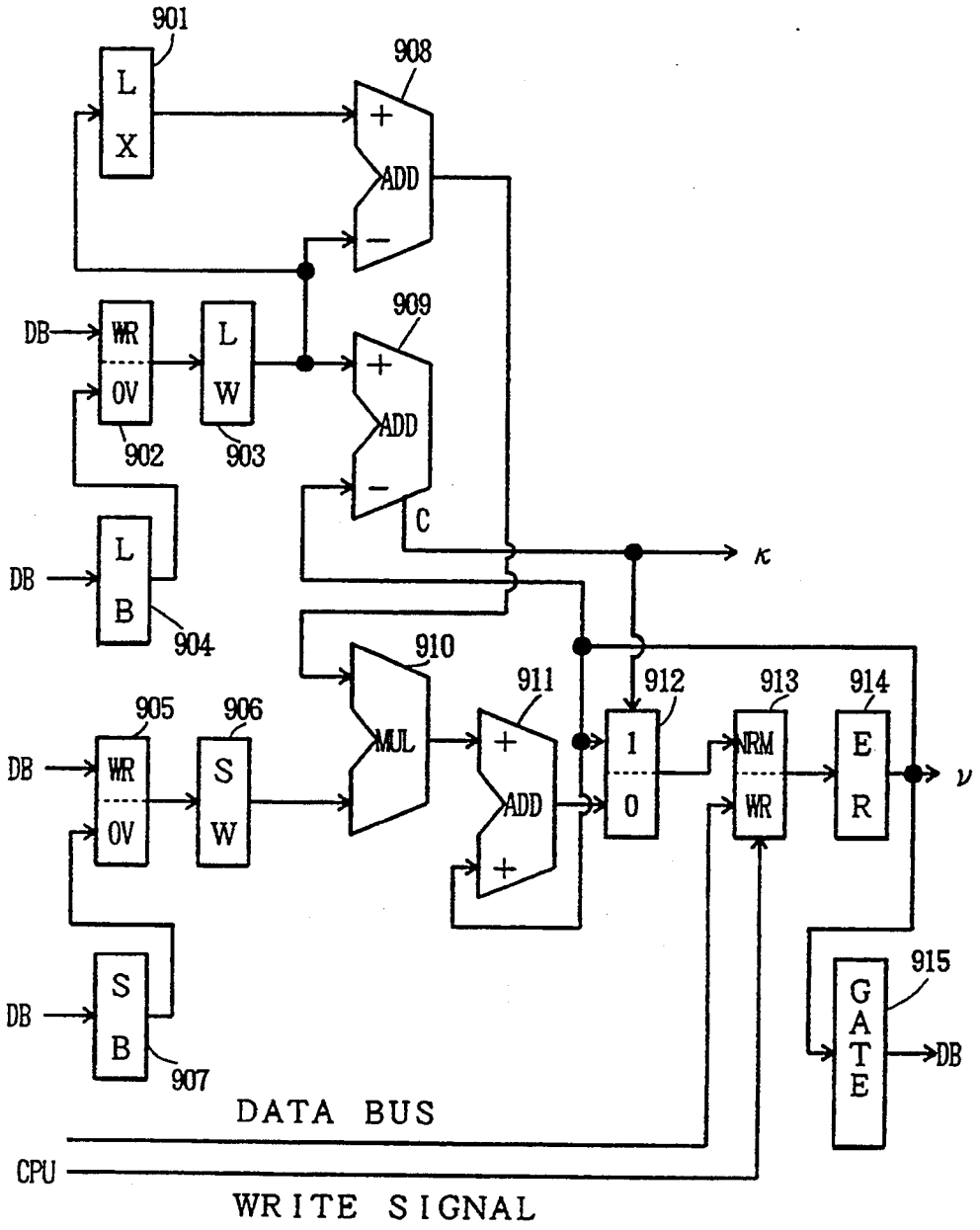
FIG. 9 is a block diagram illustrating the arrangement of a cut-off frequency changing envelope generator of the electronic musical instrument according to the present invention.

FIG. 9 illustrates the detailed example arrangement for the envelope generator (EG(1)) 205 depicted in FIG. 2. An LX 901 is a RAM in which is stored a target value that is updated after a received value has reached the previous target value. An address in this instance is a pointer to an oscillator number.

A selector 902, which has a gate, selects WR when a write signal from the CPU 1 (FIG. 1) is received via the data bus DB 6, selects OV when overflow signal $\kappa$ is received, and selects neither in other cases.

An LW 903 is a RAM in which is stored a current target value for an envelope. An address in this example is a pointer to an oscillator number. An LB 904 is a RAM in which is stored the target value of the next phase for an envelope. The input to the LB 904 is a write signal that is transmitted via the DB 6 from the CPU 1 (FIG. 1). An address in this instance is a pointer to an oscillator number. A selector 905, which has a gate, functions the same as the selector 902.

An SW 906 is a RAM in which is stored a current speed of an envelope. An address in this case is a pointer to an oscillator number. An SB 907 is a RAM in which is stored the speed of the next phase of the envelope. The input to the SB 907 is a signal that is transmitted from the CPU 1 (FIG. 1) via the DB 6. An address in this case is a pointer to an oscillator number.

An adder 908 subtracts the output of the LW 903 from the output of the LX 901 to acquire the absolute value. An adder 909 subtracts output $\nu$ (current value) of an ER 914, which will be described later, from the output (target value) of the LW 903, and generates a carry signal c under predetermined conditions.

A multiplier 910 multiplies the output of the SW 906 by the output of the adder 908. An adder 911 adds the output of the multiplier 910 to output $\nu$ (current value) of the ER 914, which will be described later. A selector 912 selects "1" when overflow signal $\kappa$ is received, and selects "0" for the other cases.

A selector 913 selects WR when it receives a write signal from the CPU 1 (FIG. 1) via the DB 6, and selects NRM for the other cases. The ER 914 is a RAM in which the current value of an envelope is stored. An address in this case is a pointer to an oscillator number. A gate 915 is a three-state gate circuit that transmits the output of the ER 914 to the DB 6 in consonance with the data read by the CPU 1 (FIG. 1).

Figure 10:
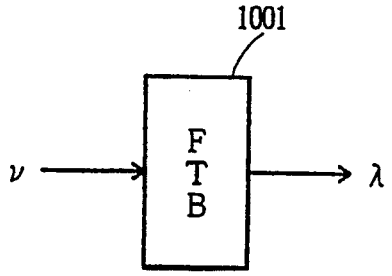
FIG. 10 is a block diagram showing the circuit arrangement, of the electronic musical instrument according to the present invention, that converts output $\nu$ of the cut-off frequency changing envelope generator into address signal $\lambda$.

FIG. 10 shows the example arrangement of a converter that converts output $\nu$ of the envelope generator (EG(1)) 205 (FIG. 2) into an address signal $\lambda$ for each of the circuits 802, 804, 808, 816, and 818 in FIG. 8. An FTB 1001 is a conversion table ROM, $\nu$ is an address and $\lambda$ is an output.

Figure 11:
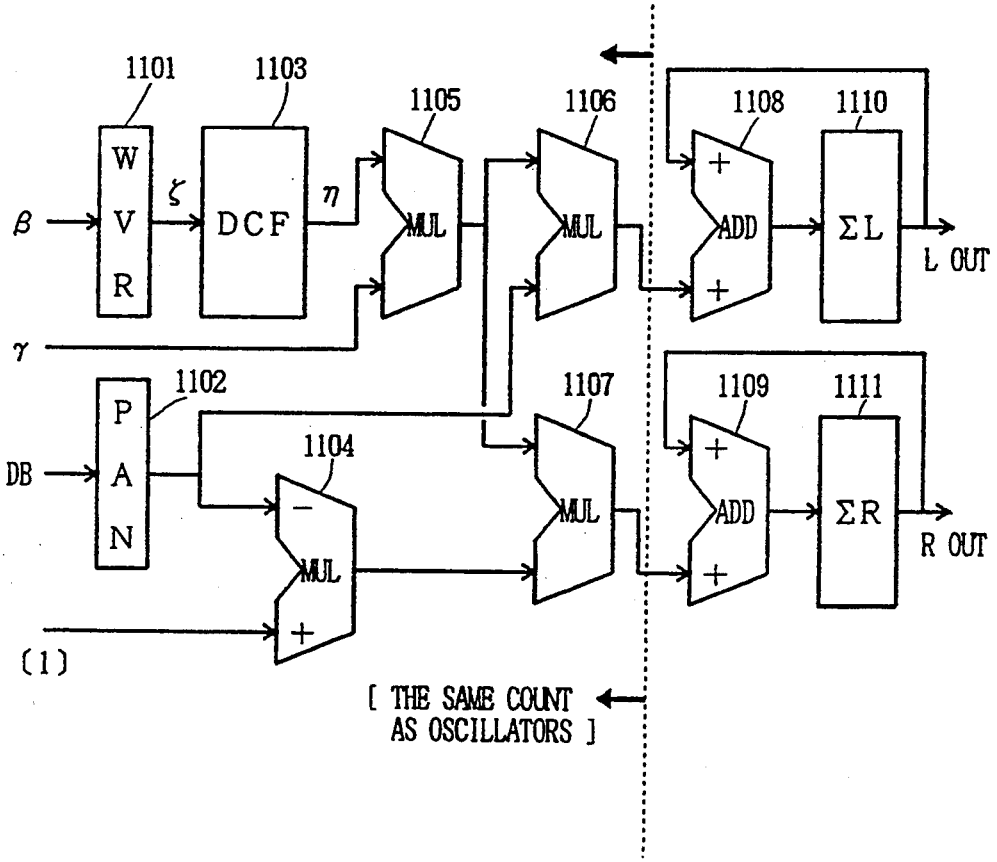
FIG. 11 is a block diagram showing the circuit arrangements of a digital control amplifier and a digital mixer of the electronic musical instrument according to the present invention.

FIG. 11 shows the detailed, full circuit arrangements of the digital control amplifier (DCA) 202 and the digital mixer 203 shown in FIG. 2. A WVR 1101, a waveform ROM, is part of the ROM 2 in FIG. 1. $\beta$ is an address and $\zeta$ is an output. A PAN 1102 is a RAM in which is stored stereo localization data. Input data is transmitted from the CPU 1 (FIG. 1). An address in this case is a pointer to an oscillator number. A DCF 1103, a digital control filter, is a re-depiction of the DCF 201 in FIG. 2.

An adder 1104 subtracts the output of the PAN 1102 from input [1]. A multiplier 1105, which is shown in the circuit example for the digital control amplifier (DCA) 202 in FIG. 2, multiplies the output of the DCF 1103 and data $\gamma$. A multiplier 1106 multiplies the outputs of the PAN 1102 and the multiplier 1105, and a multiplier 1107 multiplies the outputs of the adder 1104 and the multiplier 1105. Adders 1108 and 1109 accumulate respectively the outputs of an $\Sigma$L 1110 and $\Sigma$R 1111, which are latch circuits in which accumulated output data are stored. The arithmetic operations executed here are performed in consonance with an oscillator cycle. At the beginning of their system sampling cycles, the $\Sigma$L 1110 and the $\Sigma$R 1111 are cleared.

Figure 12:
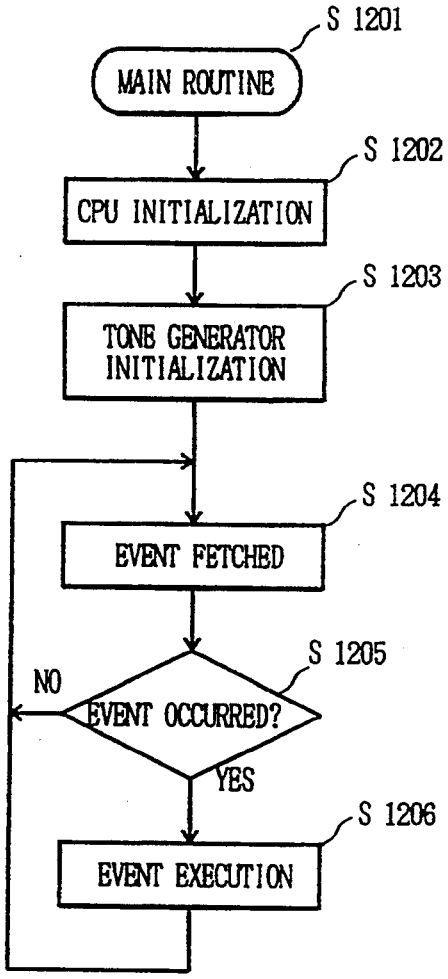
FIG. 12 is a flowchart for explaining the processing of the main routine of one embodiment of the electronic musical instrument according to the present invention.

FIG. 12 is a flowchart showing the main routine for the electronic musical instrument according to the present invention. At the start of the main routine (step S1201), the CPU 1 (FIG. 1) is initialized (step S1202). Then, the tone generator 4 (FIG. 1) is initialized (step S1203).

After the initialization, a check is performed to determine whether an event has occurred, for example, to determine whether a panel switch has been manipulated (steps S1204 and S1205). When an event has occurred, it is executed (step S1206) and event checking continues (steps S1204 through S1206).

Figure 13:
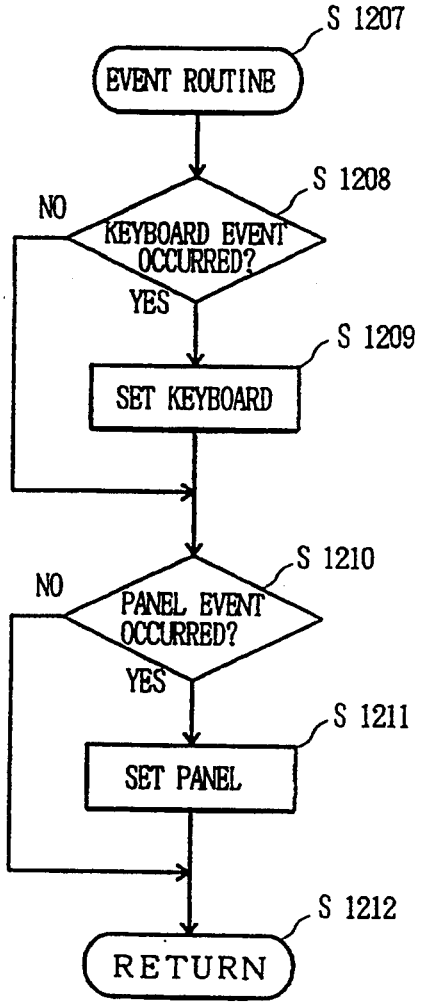
FIG. 13 is a flowchart for explaining the processing of an event routine of the embodiment of the electronic musical instrument according to the present invention.

Processing in FIG. 13 is initiated by, for example, a timer interrupt, and a check is first performed to determine whether an event originating at the keyboard has occurred (step S1208). When such an event has occurred, a keyboard event is set (step S1209). Next, a check is performed to determine whether an event originating at a panel has occurred (step S1210). When such an event has occurred, a panel event is set (step S1211).

When no event has occurred, program control is returned to the main routine.

Figure 14:
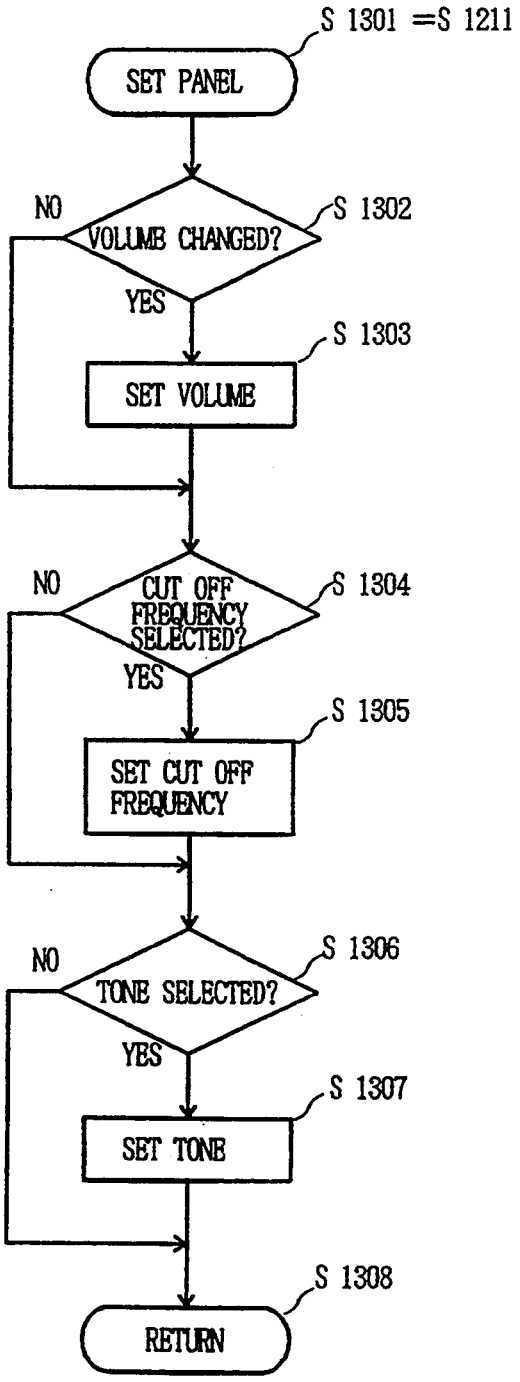
FIG. 14 is a flowchart for explaining the panel setting procedure of the embodiment of the electronic musical instrument according to the present invention.

FIG. 14 is a detailed flowchart for the panel event setting (step S1211) in FIG. 13. The panel event setting (step S1301) in FIG. 14 corresponds to step S1211 in FIG. 13. First, a check is performed to determine whether or not a volume change is required (step S1302). When a volume change is required, volume is adjusted (step S1303). A check is then performed to determine whether or not a cut-off frequency change is required (step S1304). When such a change is indicated, a cut off frequency is changed (step S1305).

Sequentially, a check is performed to determine whether a tone number alteration is required (step S1306). When such an alteration is indicated, a tone number is altered (step S1307). Program control is then returned to the routine in FIG. 13 (step S1308). When the alteration is not indicated, program control is also returned to the routine in FIG. 13 (step S1308).

Figure 15:
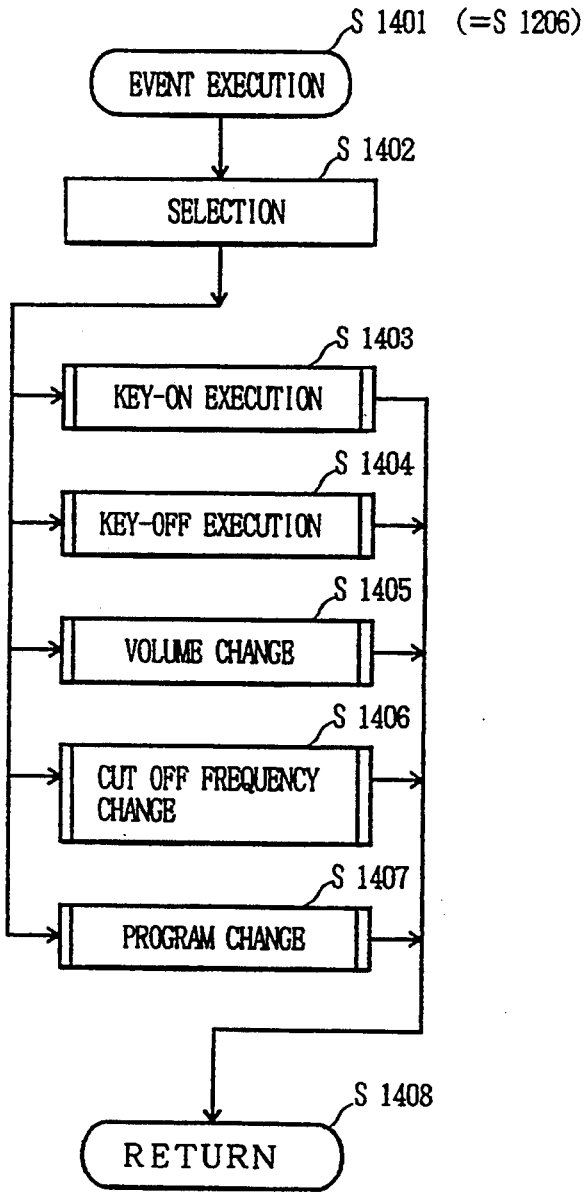
FIG. 15 is a flowchart for explaining event execution of the embodiment of the electronic musical instrument according to the present invention.

FIG. 15 shows a detailed flowchart for the event execution (step S1206) in FIG. 12. Event execution (step S1401) therefore corresponds to step S1206. The processing that is performed is based on Table 1.

TABLE 1

| event | byte 0 | byte 1 | byte 2 | byte 3 |
|---|---|---|---|---|
| key ON | 009H | key number | key touch | channel |
| key OFF | 008H | key number | (ignored) | channel |
| volume | 001H | volume (lower) | volume (upper) | channel |
| cut off | 002H | frequency (lower) | frequency (upper) | channel |
| timbre change | 00CH | timbre number | (ignored) | channel |

Selection is initiated by reading a value held in byte 0 (step S1402). Then, either a key-ON execution (step S1403), a key-OFF execution (step S1404), a volume change (step S1405), a cut-off frequency change (step S1406), or a timbre change (step S1407) is performed or several executions are combined and performed. Program control is then returned to the main routine (step S1408).

Figure 16:
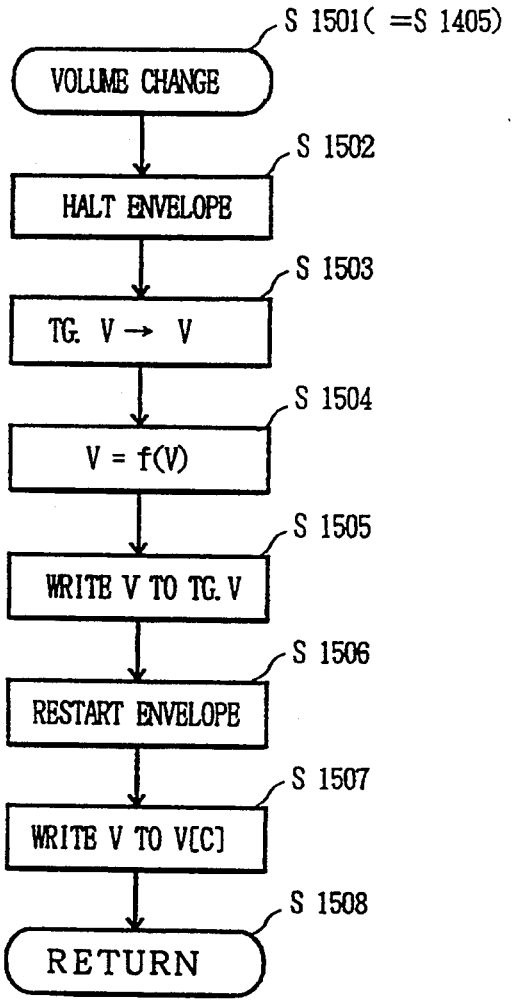
FIG. 16 is a flowchart for explaining a volume and a cut-off frequency changing process of the embodiment of the electronic musical instrument according to the present invention.
Figure 17:
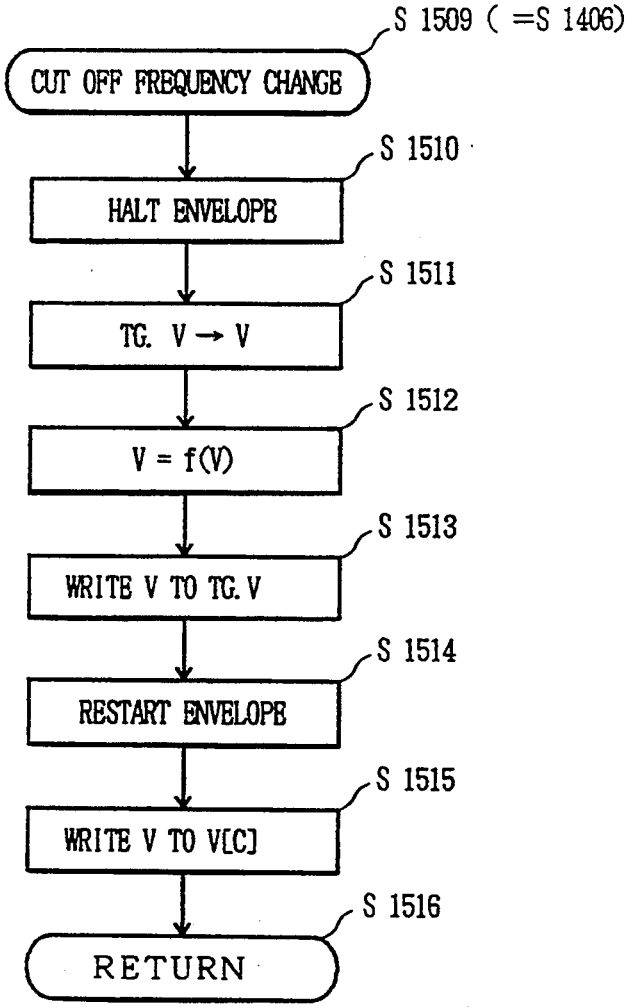
FIG. 17 is a sequential flowchart for explaining a volume and a cut-off frequency changing process of the embodiment of the electronic musical instrument according to the present invention.

FIGS. 16 and 17 are detailed flowcharts for the volume change and the cut-off frequency change in the processing in FIG. 15. In FIG. 16, which illustrates the volume change processing (step S1501) that corresponds to step S1405 in FIG. 15, initially, envelope processing is halted (step S1502).

Then, a tone generator volume, i.e., the FL 609 in FIG. 6, is loaded into register V (step S1503) and a function operation, volume V=F(V), is calculated (step S1504). Following this, the value held by the register V is written to the tone generator volume, i.e., the FL 609 in FIG. 6.

Finally,the envelope processing is restarted (step S1506), and value V is written to a tunnel volume V(c) (step S1507). Program control is then returned to the routine in FIG. 15 (step S1508).

In FIG. 17, which illustrates the cut-off frequency change (step S1509) that corresponds to step S1406 in FIG. 15, initially, envelope processing is halted (step S1510). The same processing as is performed in FIG. 16 is performed for the ER 914 in FIG. 9 (steps S1511 to S1516).

Figure 18:
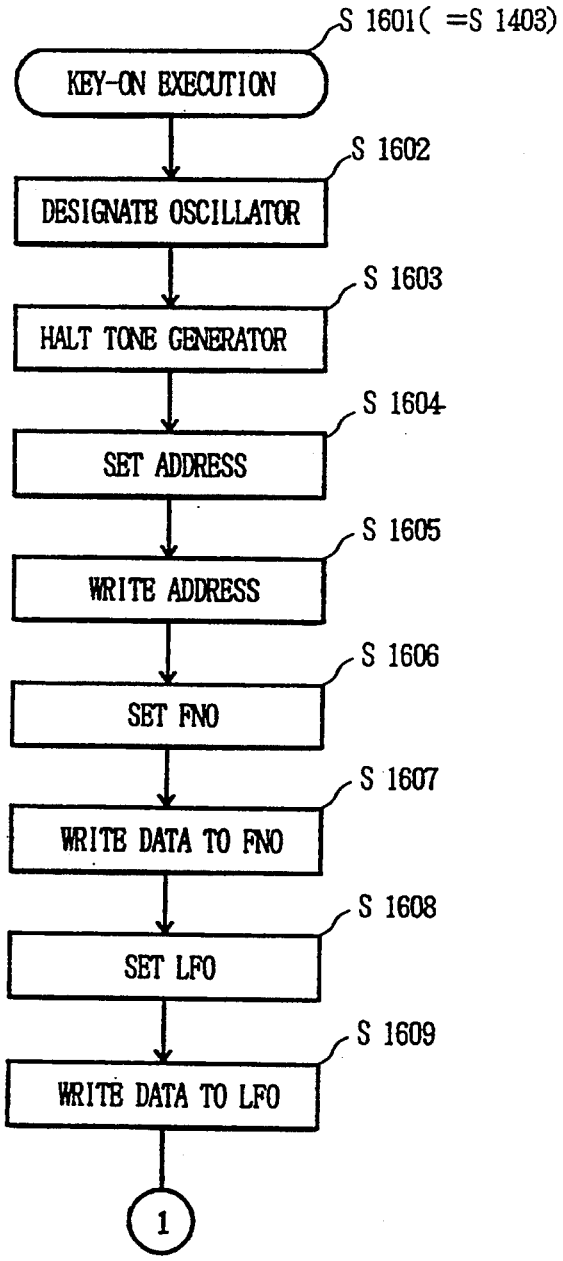
FIG. 18 is a flowchart for explaining key-ON processing of the embodiment of the electronic musical instrument according to the present invention.
Figure 19:
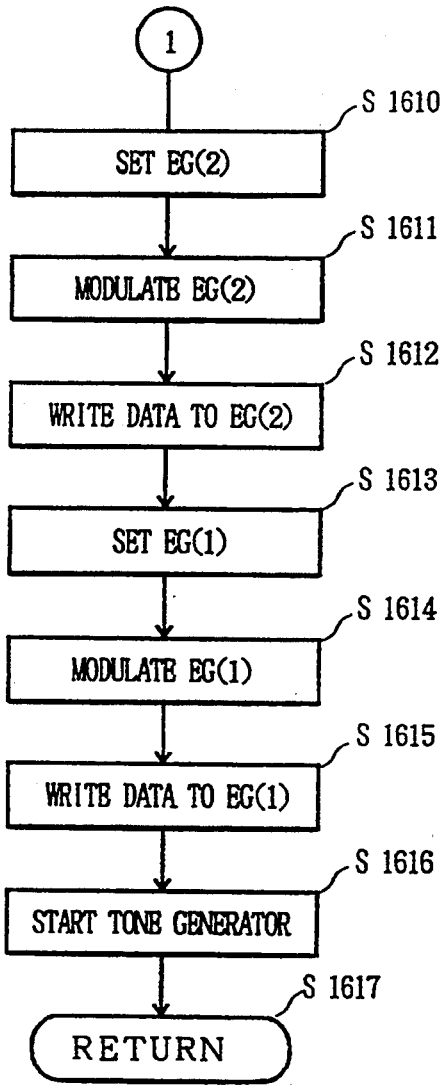
FIG. 19 is a sequential flowchart for explaining key-ON processing of the embodiment of the electronic musical instrument according to the present invention.

FIGS. 18 and 19 are detailed flowcharts for the key-ON execution procedure at step S1403 in FIG. 15 (step S1601). First, an oscillator number is designated (step S1602) and the tone generator 4 is halted in consonance with this oscillator number (step S1603). Then, a waveform address is determined in consonance with a timbre and a tone range (step S1604) and the address is written to the LTP 301, the LEP 302 and the WAD 308 in FIG. 3 (step S1605) to set the tone generator.

Sequentially thereafter, the FNO 504 in FIG. 5 is set in consonance with a key number and a timbre (step S1606), data is written to the FNO 504 (step S1607), the WSS 502 and the DPT 503 in FIG. 5 are set in consonance with a specified timbre (step S1608), and data are written to the WSS 502 and the DPT 503 (step S1609).

Following this, the envelope generator for amplitude change (EG(2) in FIG. 2) is set in consonance with a timbre (step S1610) and is modulated in consonance with key touch, etc. (step S1611), and data is written to the envelope generator (EG(2)) (step S1612).

Finally, the envelope generator for cut-off frequency change (EG(1)) is set in consonance with a timbre (step S1613) and is modulated in consonance with key touch, etc. (step S1614), data is written to the envelope generator (EG(1)) (step S1615), and the tone generator, T.G. 4, is restarted (step S1616). Program control is then returned to the routine in FIG. 15 (step S1617).

Figure 20:
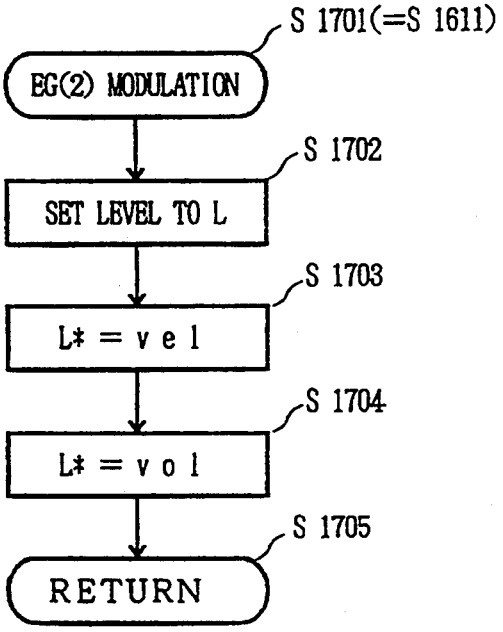
FIG. 20 is a flowchart for explaining modulation processing of the amplitude changing envelope generator of the electronic musical instrument according to the present invention.
Figure 21:
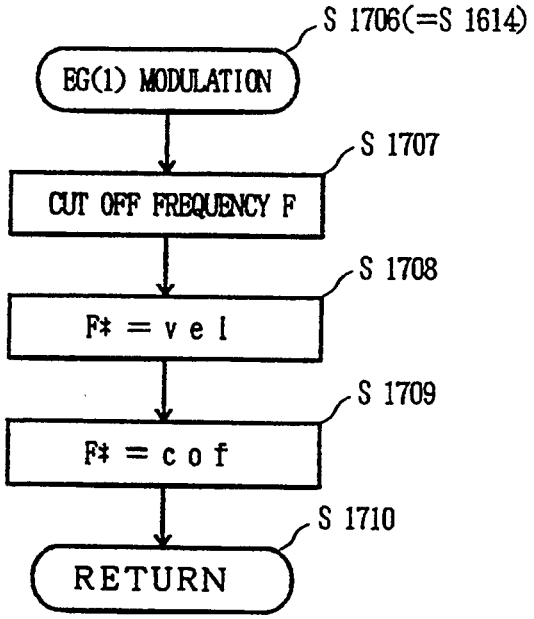
FIG. 21 is a flowchart for explaining modulation processing of the cut-off frequency changing envelope generator of the electronic musical instrument according to the present invention.

FIGS. 20 and 21 are detailed flowcharts for explaining a modulation step (step S1611), for the amplitude change envelope generator (EG(2) in FIG. 2), and a modulation step (step S1614), for the cut-off frequency change envelope generator (EG(1) in FIG. 2), shown in FIGS. 18 and 19.

FIG. 20 shows a modulation step (step S1701) for the envelope generator for amplitude change (EG(2) in FIG. 2). An amplitude level is set to predetermined amplitude L for every timbre (step S1702), and while referring to the amplitude L, volume calculations are performed in consonance with key touch and volume (steps S1703 and 1704), and the results are then written to the circuits 602, 604, 612, and 614 in FIG. 6. Program control is then returned to the routine in FIG. 19 (step S1705).

FIG. 21 shows a modulation step (step S1706) for the envelope generator for cut-off frequency change (EG(1) in FIG. 2). A cut off frequency is set as predetermined frequency F for every timbre (step S1707), and while referring to this frequency F, a cut-off frequency is determined in consonance with key touch, cut-off or offset (steps 1708 and S1709). Program control is then returned to the routine in FIG. 19 (step S1710).

Figure 22:
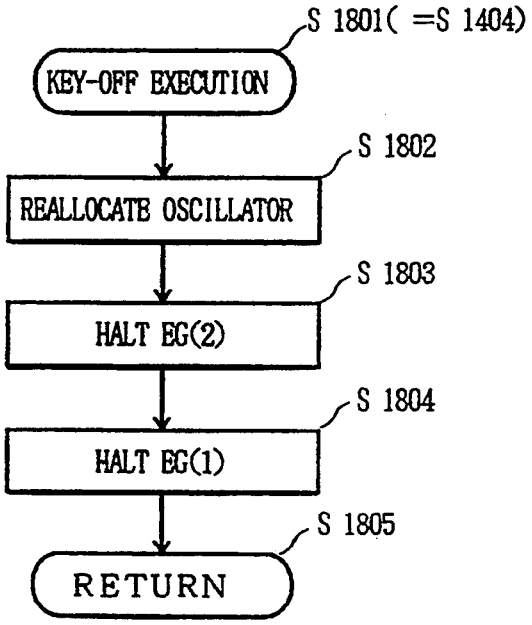
FIG. 22 is a flowchart for explaining key-OFF processing of the electronic musical instrument according to the present invention.

FIG. 22 is a detailed flowchart showing the key-OFF execution at step S1404 in FIG. 14. When the processing is initiated (step S1801), a corresponding oscillator is reallocated (step S1802), the envelope generator for amplitude change (EG(2) in FIG. 2) is shifted to the key release state (step S1803), and the envelope generator for cut-off frequency change (EG(1) in FIG. 2) is shifted to the key release state (step S1804). Then data are written to the circuits 902, 904, 906, and 907, and program control is returned to the routine in FIG. 14 (step S1803).

Although the preferred embodiment of the present invention and the claims particularly point out the subject matter regarded as the invention, various other modifications are contemplated as being within the scope of the invention.

What is claimed is:

1. An electronic musical instrument employing a given number of main oscillators to produce musical tones for the instrument, said main oscillators being capable of being modulated by a modulation frequency signal to provide sound effects to the musical tones, said musical instrument comprising:

a plurality of sub-oscillators, the number of said sub-oscillators being less than the number of main oscillators, each of said sub-oscillators producing an output having a desired frequency;

storage means for arranging the outputs of said sub-oscillators in consonance with their frequencies and for temporarily storing said outputs;

sub-oscillator selection memory means provided for each of said main oscillators; and modulation means responsive to the sub-oscillator selection memory means for a given one of said main oscillators for selecting the output of one of said sub-oscillators and for providing a modulation frequency signal for the given main oscillator having a modulation frequency corresponding to the output of the selected sub-oscillator.

2. An electronic musical instrument according to claim 1, wherein the number of said sub-oscillators that are provided is half the number of said oscillators.

3. An electronic musical instrument comprising:

oscillators for generating tone waveforms responsive to tone generation commands of the musical instrument;

modulation means coupled to said oscillators for modulating the tone waveforms;

modulation control means having a modulation control value that determines the degree of modulation to be performed by said modulation means;

central control means for controlling said oscillators, said modulation means, and said modulation control means to produce or modulate a tone waveform responsive to a tone generation command;

storage means for storing a current control value of said modulation control means; and input/output means for reading a modulation control value stored in said storage means by said central control means and/or for writing a modulation control value stored in said storage means into said central control means, the modulation control value so read or written ensuring the desired control of the degree of modulation of said modulation means by said modulation control means.

4. An electronic musical instrument according to claim 3, further comprising control means for controlling a frequency band of said oscillators.

* * * * *